United States Patent [19]

Nelson

[11] Patent Number: 4,979,428

[45] Date of Patent: Dec. 25, 1990

[54] RECIPROCATING AIR COMPRESSOR WITH IMPROVED DRIVE LINKAGE

[76] Inventor: Lester R. Nelson, 11850 Beloit Rd., Belvidere, Ill. 61008

[21] Appl. No.: 358,592

[22] Filed: May 30, 1989

[51] Int. Cl.[5] ..... F01B 9/00

[52] U.S. Cl. ..... 92/140; 74/40; 74/44; 123/197 AC

[58] Field of Search ..... 92/140; 74/40, 44; 123/197 AC, 78

[56] References Cited

U.S. PATENT DOCUMENTS

| | | | |
|---|---|---|---|
| 1,039,492 | 9/1912 | Courtright | 74/40 |
| 1,189,312 | 7/1916 | Tibbels | 74/40 |
| 1,398,260 | 11/1921 | Ford | 74/40 |
| 1,505,976 | 8/1924 | Spohree | 92/140 |
| 2,548,296 | 4/1951 | Femons | 74/40 |
| 2,822,791 | 2/1958 | Biermann | 123/197 AC |
| 2,912,814 | 11/1959 | Witt et al. | 74/44 |
| 4,131,094 | 12/1978 | Crise | 123/48 |
| 4,437,438 | 3/1984 | Mederer | 123/48 |
| 4,517,931 | 5/1985 | Nelson | 123/48 |
| 4,532,819 | 8/1985 | Ross | 74/44 |
| 4,546,663 | 10/1985 | Wood | 74/44 |

FOREIGN PATENT DOCUMENTS

| | | | |
|---|---|---|---|
| 3033088 | 4/1982 | Fed. Rep. of Germany | 92/140 |
| 766801 | of 0000 | France | 74/40 |
| 8103200 | 11/1981 | Int'l Pat. Institute | 92/140 |
| 0011990 | of 1885 | United Kingdom | 74/40 |
| 710202 | 6/1954 | United Kingdom | 123/197 AC |

*Primary Examiner*—Edward K. Look
*Assistant Examiner*—Thomas Denion
*Attorney, Agent, or Firm*—Leydig, Voit & Mayer

[57] ABSTRACT

An air compressor in which a piston is reciprocated in a cylinder by means of an eccentric. The eccentric is connected to the piston by means of a linkage consisting of an arm, a connecting rod and a control link. By virtue of the arm and the control link, the speed of the piston is greatly reduced as the piston approaches the terminal end of its compression stroke.

5 Claims, 3 Drawing Sheets

RECIPROCATING AIR COMPRESSOR WITH IMPROVED DRIVE LINKAGE

BACKGROUND OF THE INVENTION

This invention relates to an air compressor of the type having a piston which reciprocates back and forth in a cylinder. The piston sucks air into the cylinder as it moves through an intake stroke and then pressurizes the air as it moves reversely through a compression stroke. In a conventional compressor, the piston is reciprocated by means of a crank or eccentric associated with a power-rotated shaft and coupled to the piston by a connecting rod.

During initial movement of the piston through its compression stroke, torque of only relatively low magnitude need be applied to the shaft in order to move the piston since the air in the cylinder offers little resistance to such movement. As the air compresses, however, greater torque is required to move the piston and overcome the resistance of the pressurized air.

SUMMARY OF THE INVENTION

The general aim of the present invention is to provide a new and improved air compressor which is capable of operating at higher efficiency than prior compressors of the same general type.

A more detailed object of the invention is to achieve the foregoing by providing a compressor in which a unique linkage is interposed between the eccentric and the connecting rod in order to greatly reduce the speed of the piston as the piston approaches the end of its compression stroke and to use the available torque to compress the air to a higher pressure.

These and other objects and advantages of the invention will become more apparent from the following detailed description when taken in conjunction with the accompanying drawings.

DETAILED DESCRIPTION OF THE PREFERRED EMBODIMENT

Figure 1:
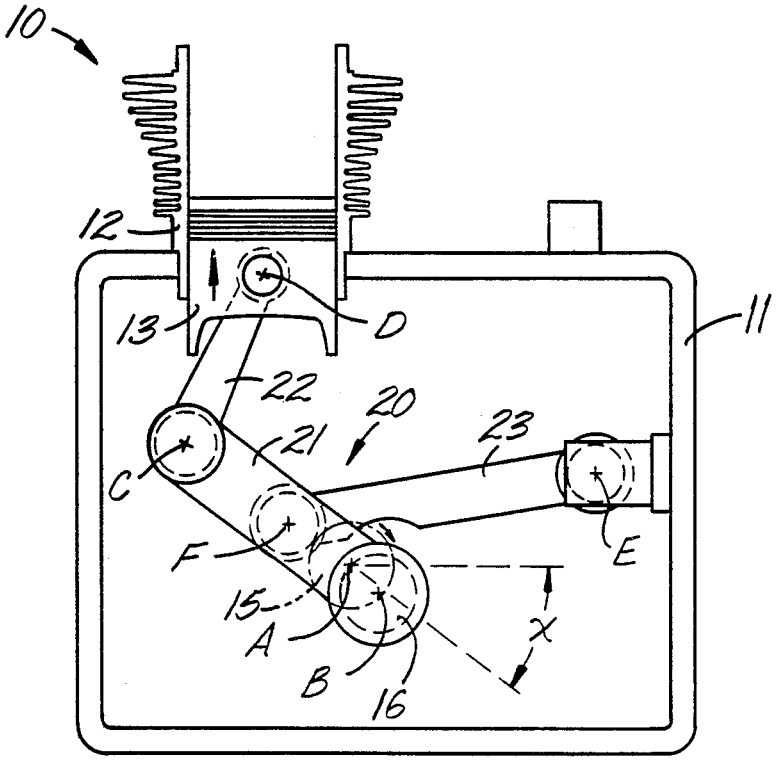
FIG. 1 is a cross-sectional view which diagrammatically illustrates a new and improved compressor incorporating the unique features of the present invention, the piston of the compressor being shown at the initial end of its compression stroke.

For purposes of illustration, the invention has been shown in the drawings as being embodied in a compressor 10 for pressurizing air. In many respects, the compressor is of conventional construction and thus the compressor has been shown in diagrammatic form and only to the extent necessary to gain an understanding of the present invention.

Briefly, the compressor 10 includes a main support 11 which may be in the form of a box-like housing. Attached to the top of the housing 11 is a vertically extending cylinder 12 which slidably receives a reciprocating piston 13. The piston draws air into the cylinder as it is shifted downwardly through an intake stroke and then pressurizes the air upon being shifted upwardly through a compression stroke.

Reciprocation of the piston 13 is effected in response to rotation of a shaft 15 which is suitably journaled by the housing 11 to turn about a first axis A which extends perpendicular to the direction of reciprocation of the piston. A motor (not shown) is located outside of the housing and is connected to the shaft to rotate the latter in a clockwise direction about the axis A. Associated with the shaft is an eccentric 16 having an axis B which extends parallel to the axis A. The eccentric may be an offset crank shaft or other member having an axis which is radially offset from the axis of the drive shaft.

In accordance with the present invention, the eccentric 16 is connected to the piston 13 by a unique linkage 20 which reduces the speed of the piston as the piston approaches the terminal end of its compression stroke and enables the compressor 10 to operate with higher efficiency. Herein, the linkage 20 includes an arm 21 whose lower end is connected to the eccentric 16 to turn relative to the eccentric about the axis B. The upper end of the arm 21 is pivotally connected to the lower end of a connecting rod 22 to turn relative to the connecting rod about a third axis C extending parallel to the axis A. At its upper end, the connecting rod 22 is coupled to the piston 13 by a conventional wrist pin to turn relative to the piston about a fourth axis D which also extends parallel to the axis A.

Completing the linkage 20 is a control link 23 having one end connected to the housing 11 to rock about a fifth axis E extending parallel to the axis A. The opposite end of the control link 23 is connected to the arm 21 between the ends thereof to pivot relative to the arm about a sixth axis F extending parallel to the axis A. In this instance, the pivot axis F is located approximately midway along the length of the arm 21 and thus is approximately midway between the axis B and the axis C.

The axis A of the shaft 15 is located in a vertical plane which is offset transversely from the vertical plane which contains the longitudinal axis of the cylinder 12. The pivot axis E of the control link 23 is located in a vertical plane which is offset even further from the axis of the cylinder. Thus, the vertical plane which contains the axis A of the shaft 15 is located between the vertical plane which contains the pivot axis F of the link 23 and the vertical plane which contains the axis of the cylinder 12. Also, the pivot axis E is contained in a horizontal or transversely extending plane which lies between the bottom of the cylinder 12 and a prallel horizontal plane containing the axis A of the shaft 15.

FIG. 1 shows the position of the various components when the piston 13 is located at the terminal end of its intake stroke and at the initial end of its compression stroke. When the components are so positioned, the piston is located in its lowermost position in the cylinder 12, the axis B of the eccentric is at an angle X (FIG. 1) of about forty-two degrees relative to a horizontal plane containing the axis A of the shaft 15, the arm 21 is at an extreme counterclockwise position about the axis B, and the link 23 is at an extreme counterclockwise position about the axis E.

Figure 2:
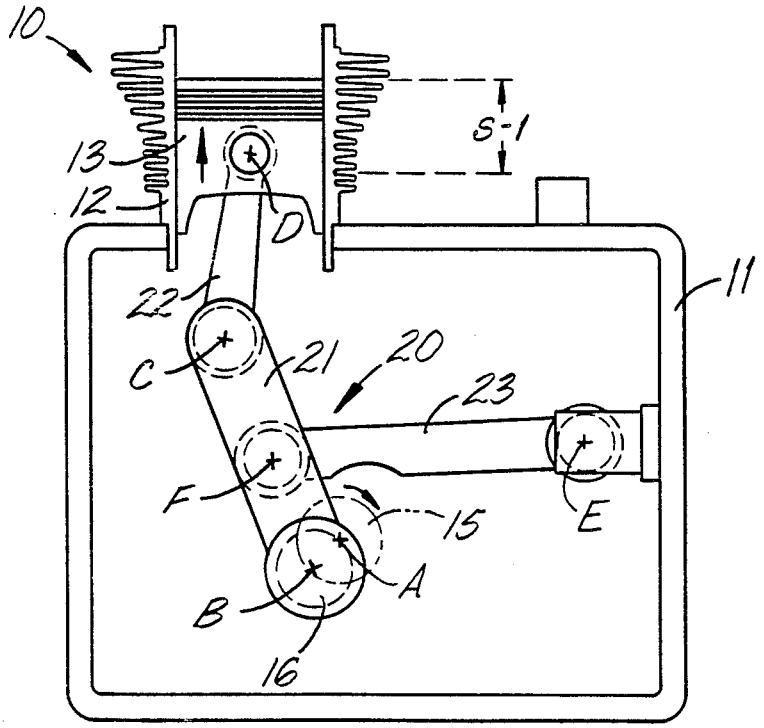
FIGS. 2 and 3 are views similar to FIG. 1 but show the piston at progressively advanced positions during its compression stroke.

As the shaft 15 is rotated clockwise, the eccentric 16 orbits clockwise about the axis A of the shaft and acts through the arm 21 and the connecting rod 22 to shift the piston 13 upwardly in the cylinder 12. In FIG. 2, the components have been shown as positioned after the shaft 15 has rotated clockwise through ninety degrees from the position shown in FIG. 1. As shown, the axis B of the eccentric 16 has moved to approximately a seven-thirty o'clock position relative to the axis A of the shaft 15, the arm 21 has rocked clockwise about the axis B, and the link 23 has rocked clockwise about the axis E. As a result of these motions, the piston 13 is advanced upwardly in the cylinder 12 through a distance S-1 (FIG. 2) during the first ninety degrees of rotation of the shaft and begins compressing the air in the cylinder. Because the air initially creates relatively low resistance to movement of the piston 13, the torque required to be applied to the shaft 15 to displace the piston from the position of FIG. 1 to the position of FIG. 2 is relatively low.

Figure 3:
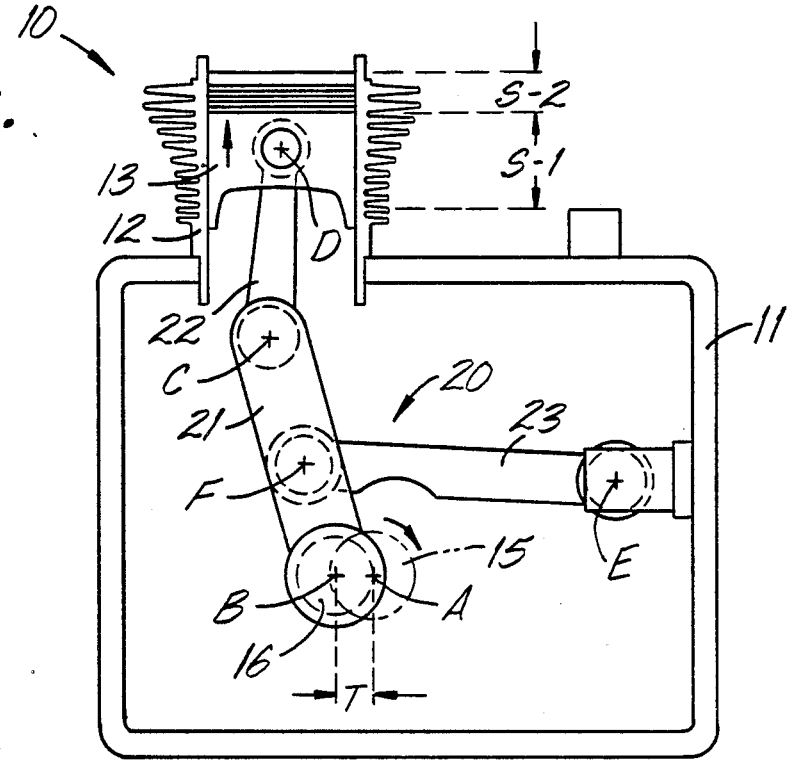

FIG. 3 shows the position of the components after the shaft 15 has rotated an additional forty-eight degrees from the position of FIG. 2 and has moved the axis B of the eccentric 16 to a nine o'clock position relative to the axis A of the shaft. The arm 21 and the link 23 have continued to swing clockwise about the axes B and E, respectively, and the piston 13 has moved upwardly in the cylinder 12 an additional distance S-2 (FIG. 3).

As clockwise rotation of the shaft 15 continues from the position shown in FIG. 3, the action of the eccentric 16 continues to push the piston 13 upwardly. As the axis B of the eccentric 16 begins moving from the position of FIG. 3, however, the arm 21 starts "toggling over" or pivoting counterclockwise about the axis B of the eccentric 16 as dictated by the control link 23. As a result of "toggling" or pivoting counterclockwise about the axis B, the arm 21 retards upward movement of the piston 13 and reduces the upward speed of the piston although the piston continues upwardly due to the action of the axis B of the eccentric 16 moving upwardly.

Figure 4:
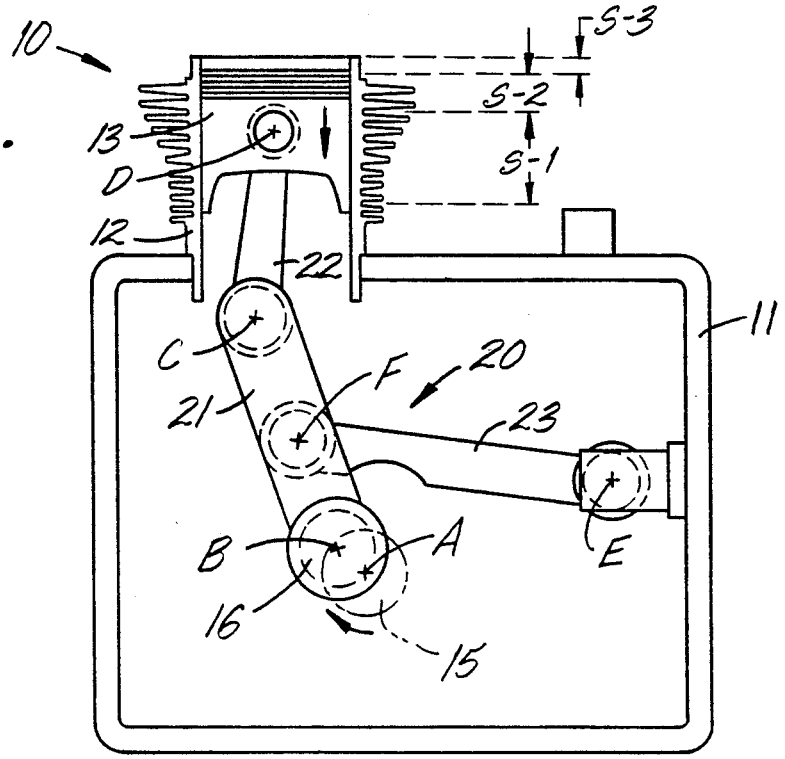
FIG. 4 is also a view similar to FIG. 1 but shows the piston at the terminal end of its compression stroke.

In FIG. 4, the axis B of the eccentric 16 has been shown as having rotated forty-two degrees from the position shown in FIG. 3 and the piston 13 has been shown as being at the top or terminal end of its compression stroke. In the forty-two degrees of rotation from the position of FIG. 3 to the position of FIG. 4, the piston advanced upwardly through only a very short distance S-3 (FIG. 4) due to the influence of the arm 21 and the link 23 on the action of the eccentric 16. Since the speed of the piston 13 is reduced greatly, the torque available at the shaft 15 is optimized to enable the piston to pressurize the air to a relatively high pressure during final upward movement of the piston when the resistance of the air to compression is the greatest. In FIG. 4, the sum of the distances S-2 and S-3 is the upward displacement of the piston 13 during the second ninety degrees of rotation of the shaft 15 and, by comparison with the displacement S-1 effected by the first ninety degrees of rotation, it is apparent that the speed of the piston is reduced significantly during the second ninety degrees of rotation and particularly during the final forty-two degrees thereof when the piston only moves through the small distance S-3.

Figure 5:
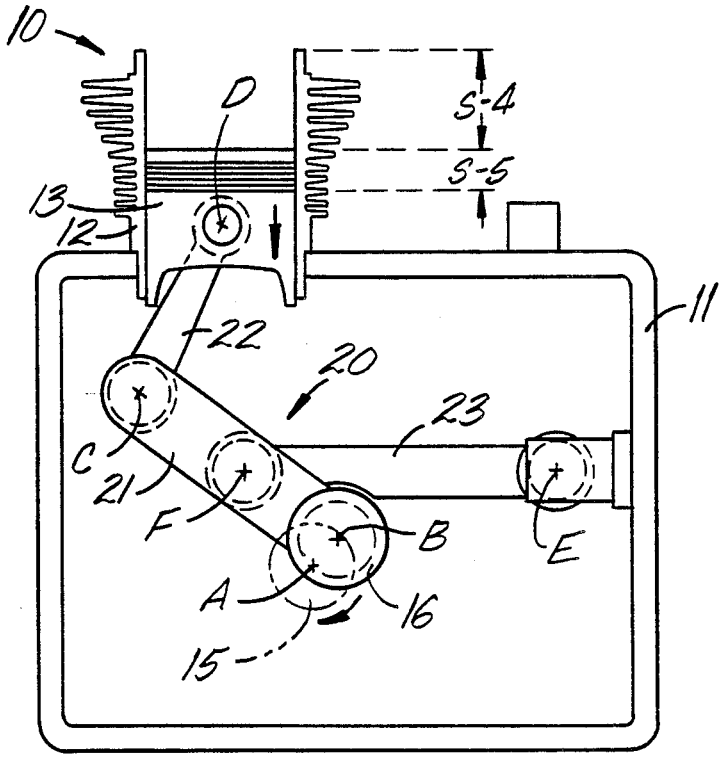
FIG. 5 is another view similar to FIG. 1 but shows the piston at an intermediate position during its intake stroke.

When the piston 13 is at the terminal end of its compression stroke (FIG. 4), the axis B of the eccentric 16 is located short of top dead center with respect to the axis A of the shaft 15 and thus is spaced from a vertical plane extending through the axis A. As the shaft 15 rotates from the position shown in FIG. 4, the axis B of the eccentric 16 approaches top dead center and thus moves toward the aforementioned plane. Even though the eccentric 16 itself tends to move the piston upwardly as the eccentric initially rotates from the position of FIG. 4, the arm 21, being forced to pivot counterclockwise about the axis B by the link 23, draws the piston downwardly and causes the piston to move through its intake stroke as the axis B of the eccentric 16 approaches top dead center. FIG. 5 shows the position of the piston 13 after the eccentric 16 has crossed top dead center and has rotated ninety degrees from the position shown in FIG. 4 and, as is apparent, the piston has been displaced downwardly through a relatively large distance S-4 during such rotation. The distance S-5 in FIG. 5 represents the downward displacement of the piston during the final ninety degrees of rotation from the position shown in FIG. 5 to the position shown in FIG. 1. As the piston moves downwardly from the position shown in FIG. 4 to the position shown in FIG. 1, the arm 21 and the link 23 pivot counterclockwise about the axes B and E, respectively, until the arm and link reach the extreme positions shown in FIG. 1 whereupon they start pivoting clockwise.

In a typical compressor 10 constructed in accordance with the invention, the cylinder 12 has a bore of 77 millimeters, the eccentric 16 has a throw T (FIG. 3) of $\frac{3}{4}''$ and the linkage 20 causes the piston 13 to move through a stroke of 3" during each one-half revolution of the shaft 15 as opposed to a conventional compressor where $\frac{3}{4}''$ throw produces a stroke of $1\frac{1}{2}''$. In the preferred compressor, the arm 21 has a length of about 5", the connecting rod 22 has a length of about $3\frac{3}{4}''$ and the link 23 has a length of about $6\frac{1}{4}''$. The axis E of the link 23 is offset horizontally from the axis A of the shaft 15 by about $4\frac{7}{8}''$ and is offset vertically from the axis A by about $1\frac{7}{8}''$.

A compressor 10 constructed in accordance with the invention is capable of developing a pressure of about 50 p.s.i. when driven by a one horsepower electric motor drawing 14.7 amps. In contract, a conventional compressor having the bore and stroke as the compressor of the invention is capable of developing a pressure of about 22 p.s.i. when driven by the same motor drawing the same current.

I claim:

1. A compressor 10 having a support 11, a cylinder 12 on said support and having a longitudinal axis, a piston 13 slidable back and forth in said cylinder, and means for reciprocating said piston in said cylinder, said means comprising:

(a) a power-rotated shaft 15 journaled by said support to turn about a first axis A extending perpendicular to the direction of movement of said piston, (b) an eccentric 16 rotatable with said shaft and having a second axis B extending parallel to said first axis A, (c) an arm 21 having first and second ends, the first end of said arm being connected to said eccentric and being turnable relative to the eccentric about said second axis B, (d) a connecting rod 22 having one end connected to the second end of said arm to pivot relative to said arm about a third axis C extending parallel to said first axis A, said connecting rod having an opposite and connected to said piston to pivot relative to said piston about a fourth axis D extending parallel to said first axis A, and (e) a control link 23 having one ends connected to said support to pivot about a fifth axis E extending parallel to said first axis A, said control link having an opposite end connected to said arm between the ends thereof to pivot relative to said arm about a sixth axis F extending parallel to said first axis A, said fifth axis E being spaced laterally a substantial distance from a plane extending through said first axis A and disposed parallel to the longitudinal axis of said cylinder, said sixth axis F lying on a straight line extending between said second axis B and said third axis C.

2. A compressor as defined in claim 1, in which said first, fourth and fifth axes are located in separate first, fourth and fifth parallel planes, respectively, extending parallel to the longitudinal axis of said cylinder, said first plane being located between said fourth and fifth planes.

3. A compressor as defined in claim 2 in which said piston is moved in one direction through a compression stroke and in the opposite direction through an intake stroke, said second axis being spaced from said first plane when said piston is at the terminal end of said compression stroke, said shaft being turned in a direction to cause said second axis to move toward said first plane as an incident to initial movement of said piston through said intake stroke.

4. A compressor as defined in claim 3 in which said first and fifth axes occupy separate transversely extending parallel planes extending perpendicular to the longitudinal axis of said cylinder, the transversely extending plane occupied by said fifth axis being located between the cylinder and the transversely extending plane occupied by said first axis.

5. A compressor as defined in claim 4 in which said sixth axis is located approximately midway between said second axis and said third axis.

* * * * *